US009004302B2

(12) United States Patent
Ginzburg et al.

(10) Patent No.: US 9,004,302 B2
(45) Date of Patent: Apr. 14, 2015

(54) PACKAGE WITH FOIL SEALS AND PENETRATING MEANS

(75) Inventors: Jean-daniel Ginzburg, Viry (FR); Martinas Jurgis Kuslys, Grosshocstetten (CH)

(73) Assignee: Nestec S.A., Vevey (CH)

( * ) Notice: Subject to any disclaimer, the term of this patent is extended or adjusted under 35 U.S.C. 154(b) by 225 days.

(21) Appl. No.: 13/395,491

(22) PCT Filed: Aug. 26, 2010

(86) PCT No.: PCT/EP2010/062493

§ 371 (c)(1), (2), (4) Date: Apr. 30, 2012

(87) PCT Pub. No.: WO2011/029731

PCT Pub. Date: Mar. 17, 2011

(65) Prior Publication Data

US 2012/0211459 A1 Aug. 23, 2012

Related U.S. Application Data

(60) Provisional application No. 61/242,080, filed on Sep. 14, 2009.

(51) Int. Cl.

| | |
|---|---|
| ***B65D 25/08*** | (2006.01) |
| ***B65D 85/00*** | (2006.01) |
| ***B65D 41/00*** | (2006.01) |
| ***B65D 43/00*** | (2006.01) |
| ***B67D 1/00*** | (2006.01) |
| ***B65D 51/28*** | (2006.01) |

(Continued)

(52) U.S. Cl.

CPC ..... *B65D 51/2835* (2013.01); *B65D 51/227* (2013.01); *B65D 81/3211* (2013.01); *B65D 2101/0023* (2013.01)

(58) Field of Classification Search

USPC ..... 215/227, 257, 297, 301; 222/80, 81, 83; 206/0.5, 222

See application file for complete search history.

(56) References Cited

U.S. PATENT DOCUMENTS 2,362,025 A * 11/1944 Price ..... 604/88
3,802,604 A * 4/1974 Morane et al. ..... 222/83

(Continued)

FOREIGN PATENT DOCUMENTS

DE 10143537 A1 4/2003
DE 202005018161 U1 2/2006

(Continued)

OTHER PUBLICATIONS

Machine translation into English of the Description of German patent DE 20 2005 018 161 from espacenet. Feb. 2014.*

(Continued)

*Primary Examiner* — Fenn Mathew
*Assistant Examiner* — James N Smalley
(74) *Attorney, Agent, or Firm* — K&L Gates LLP

(57) ABSTRACT

Improved packages, methods for manufacturing the packages and methods for producing beverages using the packages are provided. The packages (10) include a cap (60), a container (20), and an adapter (30) positioned between and connected to the cap and container. The adapter (30) is configured to penetrate seals (28, 66) on the cap and the container by means of a spike member (50) to allow contents (p) of the cap (60) to mix with contents (d) of the container (20).

16 Claims, 7 Drawing Sheets

(51) Int. Cl.
*B65D 51/22* (2006.01)
*B65D 81/32* (2006.01)

(56) References Cited

U.S. PATENT DOCUMENTS

| | | | | |
|---|---|---|---|---|
| 5,370,222 | A * | 12/1994 | Steigerwald et al. | 206/222 |
| 6,152,296 | A * | 11/2000 | Shih | 206/222 |
| 6,926,138 | B1 * | 8/2005 | Basham et al. | 206/222 |
| 2002/0087141 | A1 | 7/2002 | Zinger et al. | |
| 2002/0189956 | A1 | 12/2002 | Schoo et al. | |
| 2006/0037967 | A1 * | 2/2006 | Kastenschmidt et al. | 222/81 |
| 2007/0039975 | A1 | 2/2007 | Bochtler | |

FOREIGN PATENT DOCUMENTS

| | | | |
|---|---|---|---|
| EP | 0570939 | A1 | 11/1993 |
| EP | 0599189 | A2 | 6/1994 |
| EP | 0770561 | A1 | 5/1997 |
| JP | 5743785 | | 9/1982 |
| JP | 2001333961 | | 12/2001 |
| JP | 2004299760 | | 10/2004 |
| JP | 2004329956 | | 11/2004 |
| JP | 2006176208 | | 7/2006 |
| JP | 2009067412 | | 4/2009 |

OTHER PUBLICATIONS

Written Opinion and International Search Report issued Oct. 29, 2010 for corresponding Intl. Appln. No. PCT/EP2010/062493.

Japanese Office Action 2012-529195 dated Mar. 25, 2014, 11 pages.

* cited by examiner

PACKAGE WITH FOIL SEALS AND PENETRATING MEANS

CROSS REFERENCE TO RELATED APPLICATIONS

The present application is a National Stage of International Application No. PCT/EP2010/062493, filed on Aug. 26, 2010, which claims priority to U.S. Provisional Patent Application No. 61/242,080, filed on Sep. 14, 2009, the entire contents of which are being incorporated herein by reference.

BACKGROUND

The present disclosure relates generally to sterile packaging. More specifically, the present disclosure relates to improvements in aseptic packaging of food ingredients into various containers.

Aseptic filling of food materials into containers is commonly known in the industry as an often used method for providing shelf stable food products that do not require refrigeration or freezing before and after purchase. Aseptic filling of food materials into rigid containers (cups, bottles etc.) requires the sterilizing of the product as well as the packaging material housing the product. Packaging material is typically sterilized by hydrogen peroxide, superheated steam or gamma-irradiation. Gamma-irradiation is frequently used to sterilize closing parts on a package such as, for example, caps, foils and lids.

The use of probiotic ingredients or other sensitive ingredients (e.g. oils) is also commonly known in the industry. However, use of these ingredients is generally limited to either dry products or liquid products with a limited shelf life of two to four weeks. In order to use probiotic ingredients or other sensitive ingredients in combination with shelf stable liquid products (i.e. products with shelf stability of six weeks to two years), alternative approaches have been used such as straws (e.g. BioGaia) or caps with a separate compartment. However, such caps usually need to be sterilized by gamma-irradiation, which can destroy or damage unstable probiotic ingredients or other sensitive ingredients contained in the caps.

SUMMARY

The present disclosure is directed to packages, methods for manufacturing the packages and methods for producing beverages using the packages. In a general embodiment, the present disclosure provides a container including a first open end sealed by a first seal, an adapter fixed to the first open end of the container and a cap including a second open end sealed by a second seal. The adapter is fixed to the second open end of the cap and is configured to penetrate the first seal and the second seal when activated.

In an embodiment, the adapter further includes a spike member positioned within the adapter and positioned between the first seal and second seal, which can both be foils. The adapter can also include a plurality of spike members. The spike member can be substantially centered within the adapter and can include a first tip adjacent the first seal and a second tip adjacent the second seal.

In an embodiment, the adapter further includes an annular ledge on the inside wall of the adapter. The ledge can be configured to receive the cap and fix the adapter to the second open end of the cap. The adapter can further include internal threads configured to threadeably engage external threads on the container to fix the adapter to the first open end of the container.

In an embodiment, the adapter is further configured to move from a first position to a second position for penetrating the first seal and the second seal. A removable band can be positioned between the adapter and the container to maintain the adapter in the first position.

In another embodiment, the present disclosure provides a method for manufacturing a package. The method includes providing a container including a first open end, a cap including a second open end, and an adapter including a first end and a second end, where the container is sterilized and filled with a liquid and the container is sealed with a first seal in a sterile environment. The method further includes filling the cap with an ingredient and sealing the cap with a second seal in a non-sterile environment, affixing the first end of the adapter over the first open end of the container, and affixing the second end of the adapter over the second open end of the cap. The method can even further include inserting a band around the container and affixing the first end of the adapter over the first open end of the container to abut the band.

In an embodiment, the ingredient is a powder. The ingredient can also be selected from a group including, for example, a probotic, an oil, or a combination thereof.

In yet another embodiment, the present disclosure provides a method for producing a beverage. The method includes providing an adapter including a spike member, a container including a first open end sealed by a first seal, and a cap including a second open end sealed by a second seal. The method further includes affixing a first end of the adapter over the first open end of the container, affixing a second end of the adapter over the second open end of the cap, and penetrating the first seal and the second seal with the spike member such that an ingredient housed in the cap mixes with a diluent housed in the container to form a beverage.

In still another embodiment, the present disclosure provides a packaged product. The packaged product includes a sealed container including a diluent and a sealed cap including an ingredient. The product also includes an adapter positioned between the container and cap. The adapter is so construed and designed that it can penetrate the container and cap to allow the ingredient to mix with the diluent An advantage of the present disclosure is to provide an improved shelf-stable package that includes shelf-sensitive ingredients.

Another advantage of the present disclosure is to provide an improved method for manufacturing a package with a cap housing shelf-sensitive ingredients.

Yet another advantage of the present disclosure is to provide an improved method for producing a beverage using a single package for mixing two components.

Still another advantage of the present disclosure is to provide an improved adapter for separating two beverage components during transport.

Another advantage of the present disclosure is to provide an improved adapter for mixing beverage two components.

Additional features and advantages are described herein, and will be apparent from the following Detailed Description and the figures.

DETAILED DESCRIPTION

The present disclosure is directed to improved packages, methods for manufacturing the packages and methods for producing beverages using the packages. In a general embodiment, the present disclosure provides a package including a container, an adapter connected to the container at one end of the adapter, and a cap connected to the other end of the adapter. The container houses a diluent and the cap houses an ingredient to be mixed with the diluent. The adapter includes a spike member positioned between the container and the cap, with a first tip of the spike member opposing a seal on the container and a second tip opposing a seal on the cap. In a first position, the tips on the spike member are adjacent the seals on the container and cap but do not penetrate the seals. The adapter is configured, in a second position, to penetrate the seals on both the container and cap, allowing the ingredient to deposit into the container and mix with the diluent to form a beverage.

As used herein, the term "diluent" includes, but is not limited to, shelf-stable liquids that are microbiologically-safe in an ambient temperature for at least six weeks. Such liquids include, for example, water, juices, carbonated beverages, and aseptically processed milk products.

As used herein, the term "ingredient" includes, but is not limited to, shelf-stable liquid compositions or dry compositions. Such ingredients include, for example, probiotics, vitamins, minerals, nutrients, medicinal compositions, and oils such as, for example, fish oils.

Figure 1:
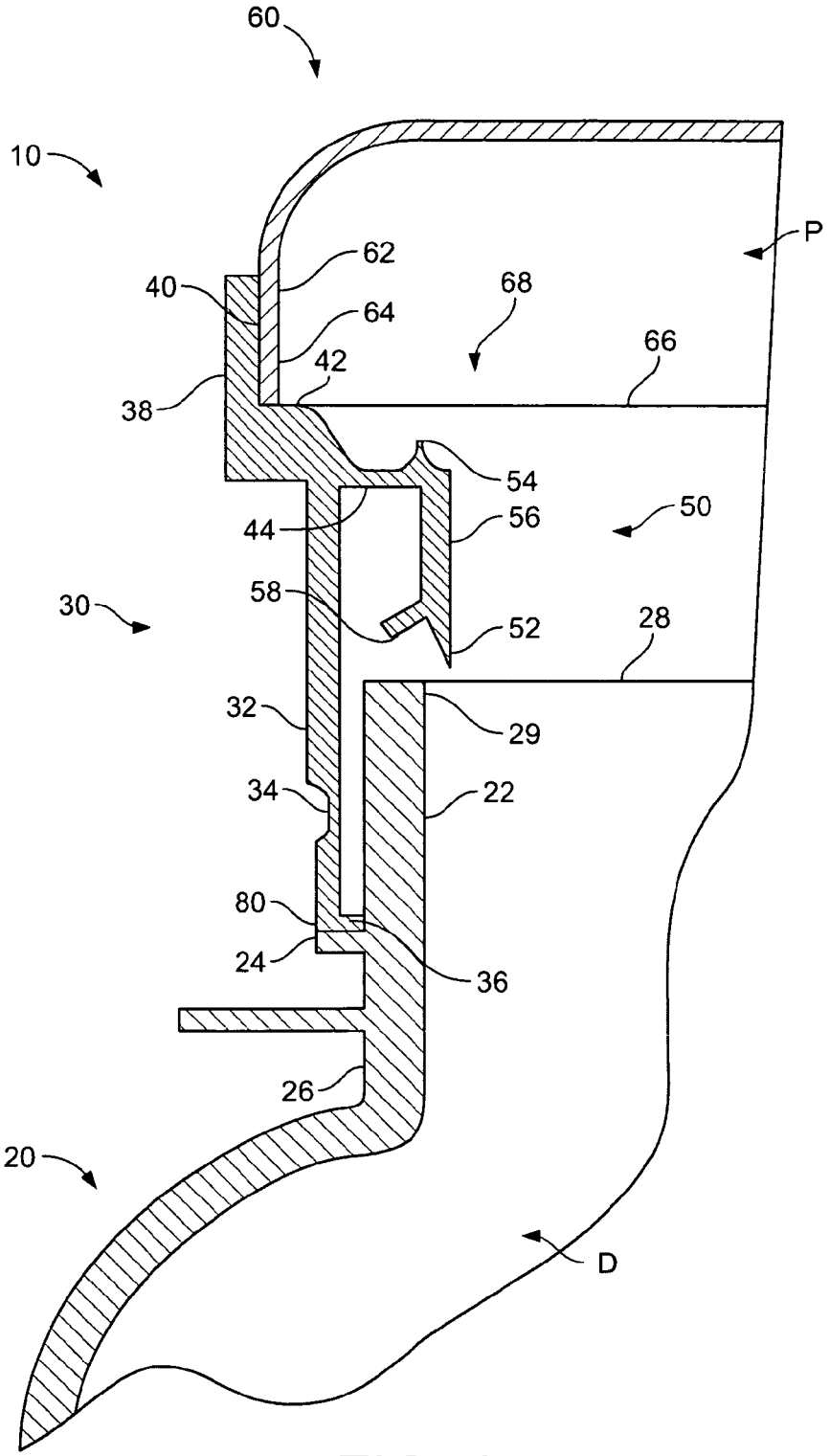
FIG. 1 illustrates a sectional view of a package in an embodiment of the present disclosure.

Referring now to the drawings and in particular the embodiment illustrated in FIG. 1, the present disclosure provides a package 10 including a container 20, an adapter 30 including a spike member 50, a cap 60, and a removable band 80.

Container 20 can be made from any rigid or semi-rigid material including, but not limited to, glass, plastic, metal, or any rigid or semi-rigid polymer. Container 20 can have any shape suitable for receiving and housing a diluent D. Container 20 can include a neck 22 and an annular ledge 24 extending from an outside wall 26 of neck 22. Container 20 is open-ended at neck 22 with a seal 28 formed over an open end 29 of container 20 to seal the interior of container 20. Seal 28 can be made from any penetrable material such as, for example, a foil.

Figure 3:
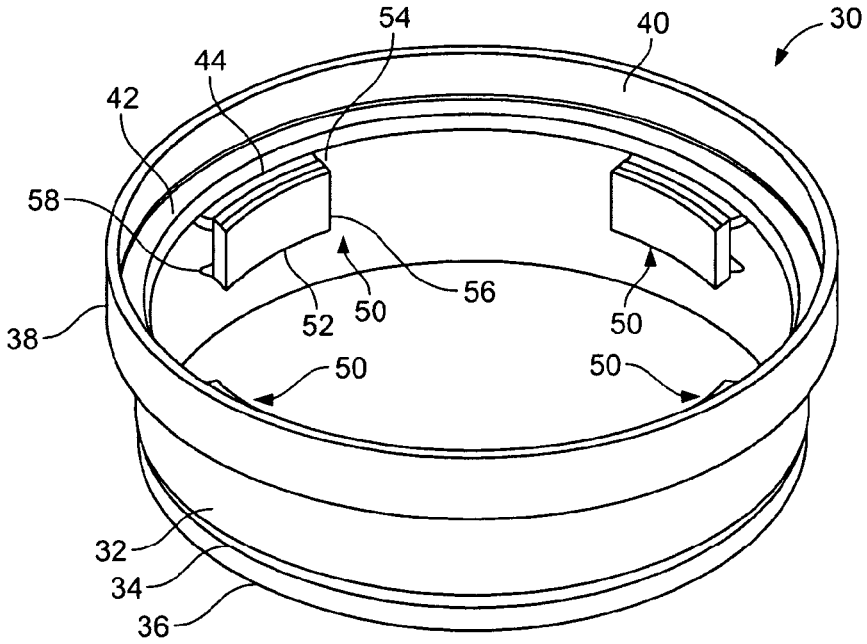
FIG. 3 illustrates a perspective view of an adapter of FIG. 1 in an embodiment of the present disclosure.

Adapter 30 can be made from any flexible or semi-flexible material including, but not limited to, any flexible or semi-flexible plastic or polymer. Adapter 30 can have any shape, such as that shown in FIG. 3, suitable for fitting between container 20 and cap 60 as will be described in more detail below. For example, as illustrated in FIG. 3, adapter 30 can be annular-shaped when the container and cap are also annular-shaped. Adapter 30 includes a lower extension 32, which includes a first weakened portion 34 and a lower end 36, an upper extension 38, which includes an inner surface 40 and an inner seat 42, and a second weakened portion 44 extending laterally inward from inner seat 42.

Spike member 50, like adapter 30, can be made from any flexible or semi-flexible material including, but not limited to, any flexible or semi-flexible plastic or polymer. Spike member 50 can be made of the same material as adapter 30 and can be molded to form a single, unitary piece with adapter 30. Spike member 50 includes a first tip 52, a second tip 54, a spike extension 56 connecting tips 52/54, and a flange 58 adjacent first tip 52. Adapter 30 can include more than one spike member 50. FIG. 3, for example, illustrates adapter 30 with four spike members 50.

Cap 60 can be made from any rigid or semi-rigid material including, but not limited to, glass, plastic, metal, or any rigid or semi-rigid polymer. Cap 60 can have any shape suitable for receiving and housing an ingredient P. Cap 60 can include a sidewall 62 having a cap end 64. Cap 60 is open-ended at end 64 with a seal 66 formed over an open end 68 of cap 60 to seal the interior of the cap. Seal 66, like seal 28, can be made from any penetrable material such as, for example, a foil.

Removable band 80 can be made from any rigid or semi-rigid polymer or plastic and has a shape and size suitable for fitting over neck 22 of container 20.

To manufacture package 10 as configured in FIG. 1, container 20 is sterilized using any known method such as, for example, hydrogen peroxide, superheated steam or gamma-irradiation. After diluent D is deposited into container 20, seal 28 is placed over open end 29 to completely seal container 20. Cap 60, like container 20, can also be sterilized using any known method. On the other hand, cap 60 may not be sterilized when cap 60 contains sensitive ingredients such as, for example, fish oil or probiotics that may be damaged or destroyed by a pre-sterilized cap. After chosen ingredient P is deposited into cap 60, seal 66 is placed over open end 68 to completely seal cap 60.

Removable band 80 is friction-fitted over neck 22 of container 20 and abuts annular ledge 24. Lower extension 32 of adapter 30 is friction-fitted over neck 22 of container 20 such that lower end 36 of adapter 30 abuts removable band 80. In an alternative embodiment, lower extension 32 can be provided with internal threads and neck 22 can be provided with external threads such that lower extension 32 threadably engages neck 22 to fix adapter 30 to neck 22 of container 20.

Cap 60 is then fitted to upper extension 38 of adapter 30 such that cap sidewall 62 friction-fits to inner surface 40 of adapter 30 and cap end 64 abuts inner seat 42 of adapter 30. As constructed, package 10 provides adapter 30 between container 20 and cap 60 such that, in a first resting position, first tip 52 of spike 50 is adjacent seal 28 of container 20 and second tip 54 is adjacent seal 66 of cap 60.

To mix diluent D and ingredient P to produce a beverage using the embodiment illustrated in FIG. 1, package 10 is initially in a first, resting position illustrated in 5A, with tips 52 and 54 of spike member 50 adjacent to but not penetrating seals 28 and 66.

Figure 5A:
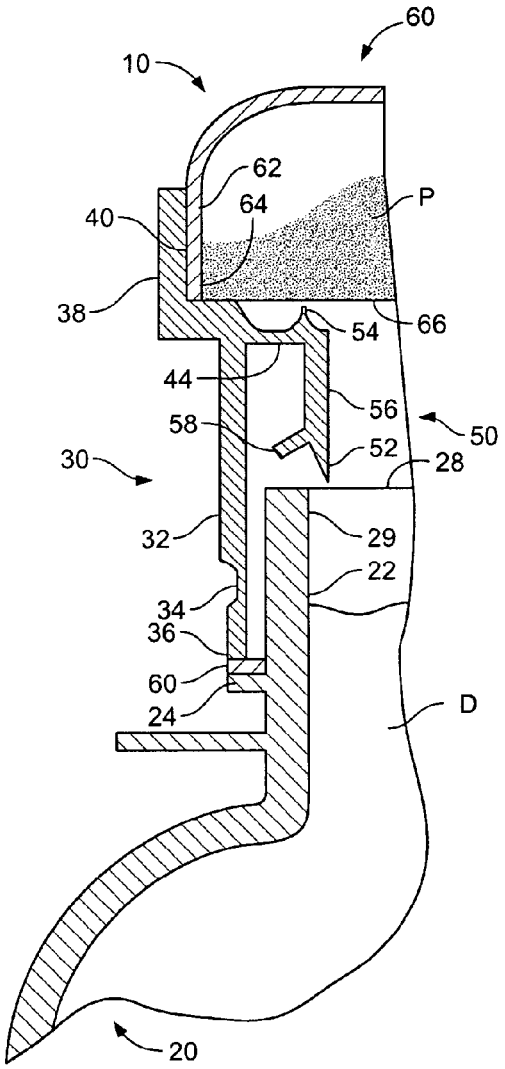
FIG. 5A illustrates sectional view of the package of FIG. 1 in a first position in an embodiment of the present disclosure.
Figure 5B:
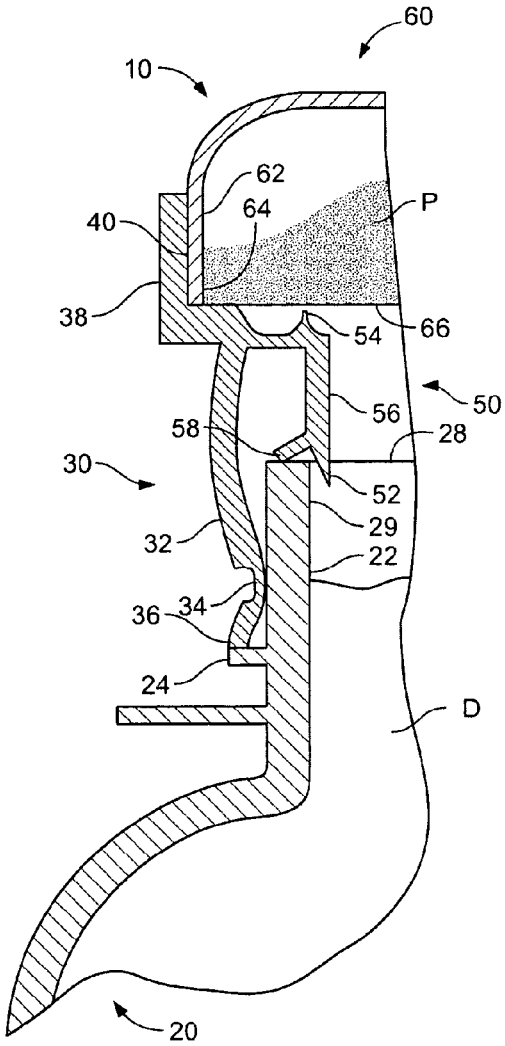
FIG. 5B illustrates sectional view of the package of FIG. 1 in a partial activated position in an embodiment of the present disclosure.

To penetrate seal 28 on container 20, band 80 is removed, allowing adapter end 36 to move along neck 22 until it abuts ledge 24, at which point neither tip 52 or 54 has penetrated associated seal 28 or 66. A downward force is then applied to cap 60 and/or adapter 30 to manipulate adapter 30 as illustrated in FIG. 5B. The downward force causes first weakened portion 34 to buckle inward and lower extension 32 to buckle outward sufficiently to allow first tip 52 to penetrate seal 28. First tip 52 continues to advance until flange 58 contacts open end 29 on neck 22.

Figure 5C:
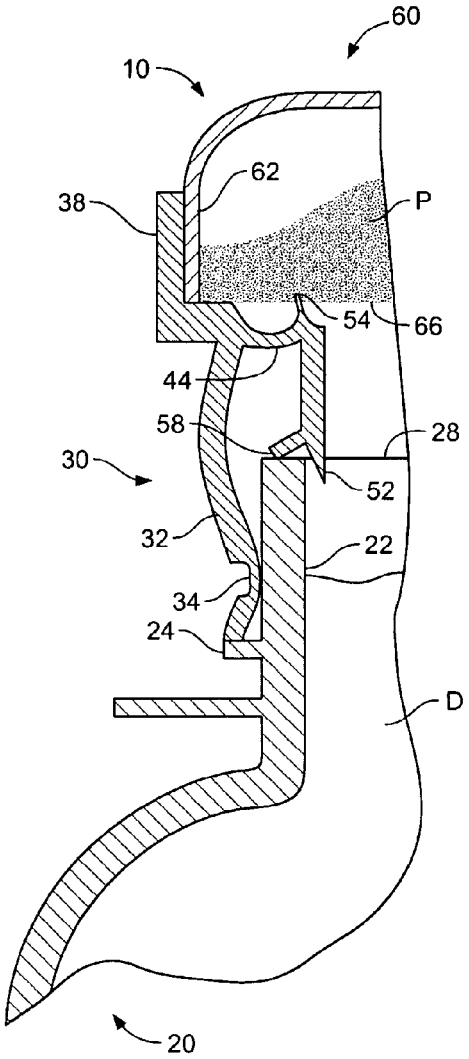
FIG. 5C illustrates sectional view of the package of FIG. 1 in a second, activated position in an embodiment of the present disclosure.

To penetrate seal 66 on cap 60, additional downward force is applied to cap 60 and/or adapter 30 to further manipulate adapter 30 as illustrated in FIG. 5C. The additional force causes first weakened portion 34 to buckle further inward and lower extension 32 to buckle further outward. As a result, second weakened portion 44 also buckles to allow second tip 54 to move upward to penetrate seal 66 on cap 60. In this second, activated position, both seals are penetrated.

Figure 5D:
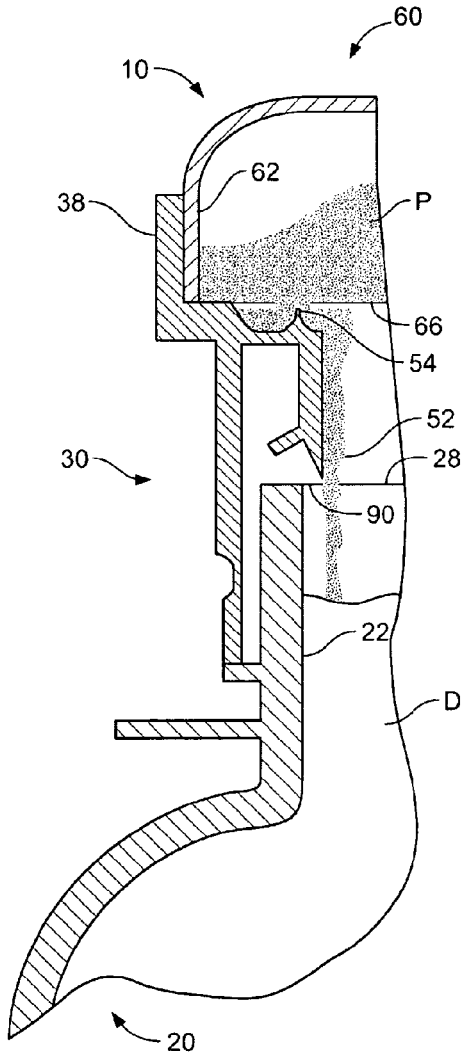
FIG. 5D illustrates sectional view of the package of FIG. 1 in a first position after activation in an embodiment of the present disclosure.

To allow ingredient P to mix with diluent D in container 20, the downward force is removed, causing adapter 30 to move back to the first, resting position illustrated in FIG. 5D. In returning to the first position, tip 52 moves to its original position outside of container 20, revealing a first hole 90 in seal 28 that provides access to diluent D. Similarly, tip 54 also moves to its original position outside cap 60, revealing a second hole 91 in seal 66 that provides an exit for ingredient P housed within cap 60. With package 10 returning to the first position, ingredient P can exit cap 60, travel through adapter 30, and mix with diluent D in container 20 to produce a beverage. A user may also shake package 10 to ensure that substantially all of ingredient P is mixed with diluent D.

Figure 2:
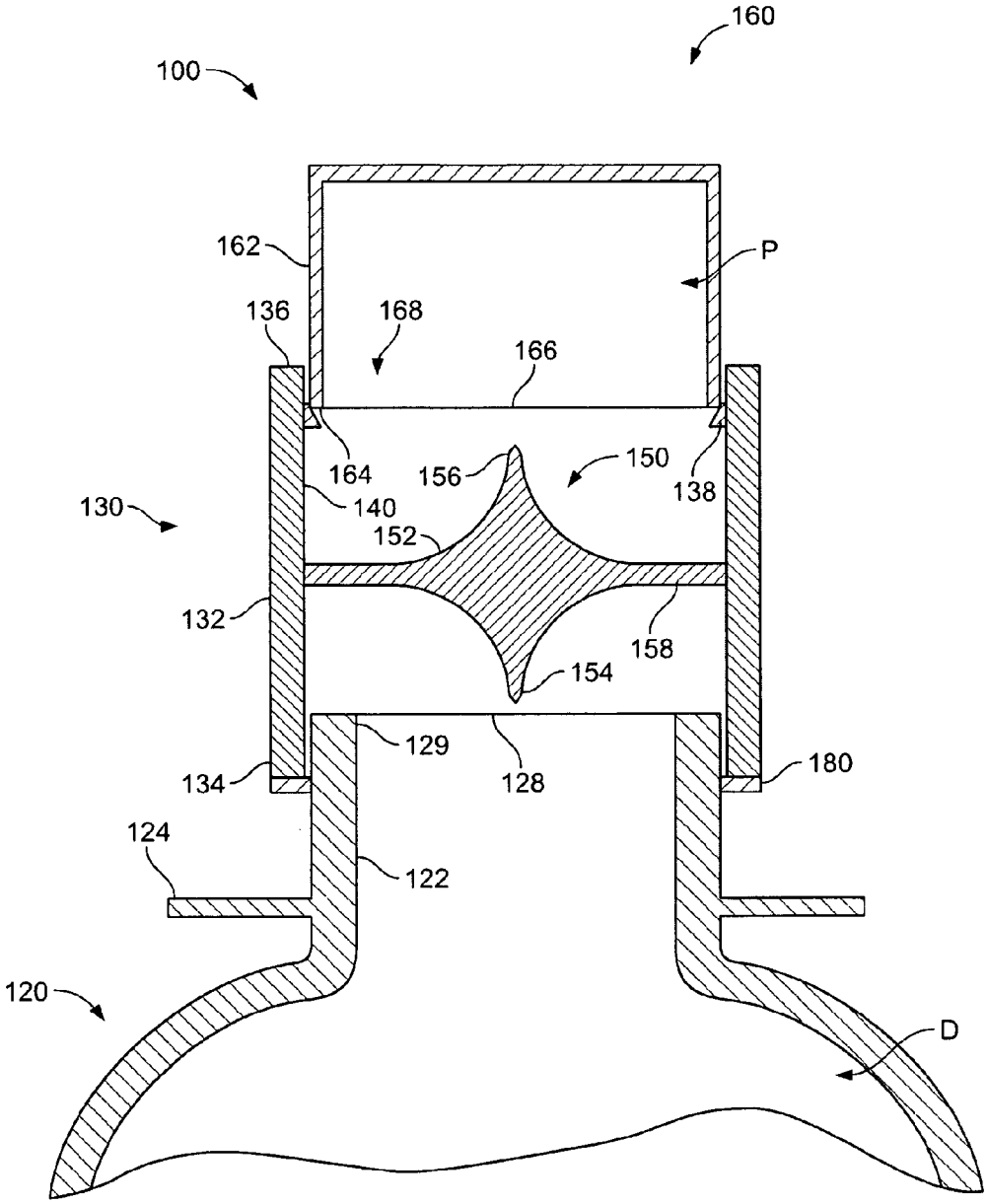
FIG. 2 illustrates a sectional view of a package in another embodiment of the present disclosure.
Figure 4:
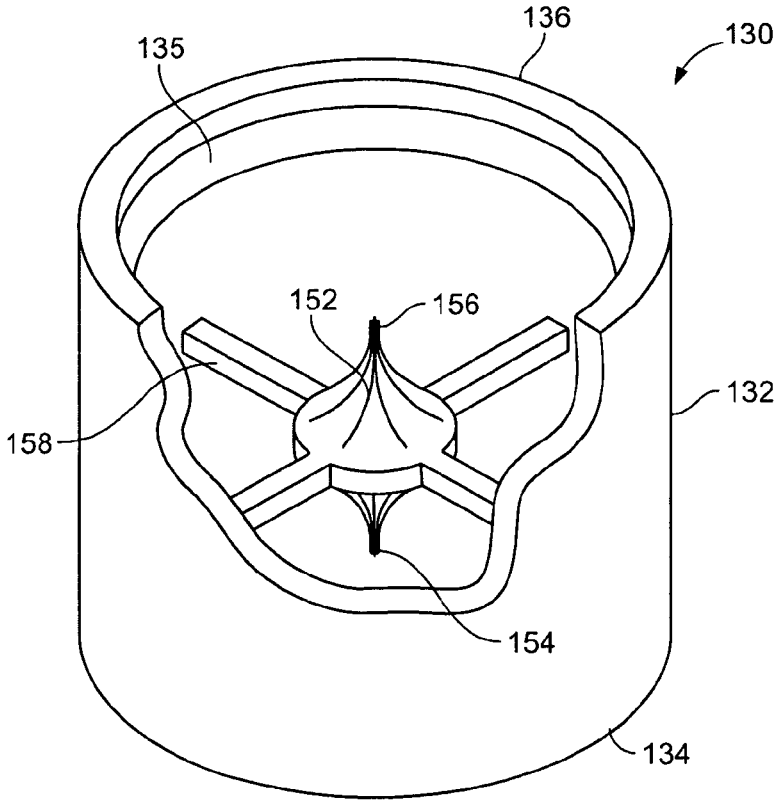
FIG. 4 illustrates a perspective view of an adapter of FIG. 2 in another embodiment of the present disclosure.

In an embodiment illustrated in FIG. 2, the present disclosure provides an adapter 130 that is modified from adapter 30 of FIG. 1. Adapter 130 can be made from any rigid or semi-rigid material including, but not limited to, any rigid or semi-rigid polymer or plastic. Adapter 130 can have any shape, such as that shown in FIG. 4, suitable for fitting between container 120 and cap 160 as will be described in more detail below. Adapter 130 includes an annular wall 132 with a first end 134 and a second end 136, the second end having a ledge 138 provided on an inner surface 140 of annular wall 132. Adapter 130 further includes a spike member 150 provided within adapter 130. Spike member 150 includes a central section 152 with first tip 154 extending below central section 152 and a second tip 156 extending above the central section. Ribs 158 connect spike member 150 to annular wall 132 such that spike member 150 is centrally disposed within adapter 130.

To manufacture package 110 as configured in FIG. 2, a container 120 is sterilized using any known method such as, for example, hydrogen peroxide, superheated steam or gamma-irradiation. After diluent D is deposited into container 120, a seal 128 is placed over an open end 129 to completely seal container 120. A cap 160, like container 120, can also be sterilized using any known method. On the other hand, cap 160 may not be sterilized when cap 160 contains sensitive ingredients such as, for example, fish oil or probiotics that may be damaged or destroyed by a pre-sterilized cap. After chosen ingredient P is deposited into cap 160, a seal 166 is placed over an open end 168 of cap 160 to completely seal cap 160.

A removable band 180 is friction-fitted over a neck 122 of container 120 Annular wall 132 of adapter 130 is friction-fitted over neck 122 of container 120 such that first end 134 of adapter 130 abuts band 180. Cap 160 is then fitted to second end 136 of adapter 130 such that a cap sidewall 162 slides within annular wall 132 until a wall end 164 rests against ledge 138 on inner surface 140 of annular wall 132. As constructed, package 110 provides adapter 130 between container 120 and cap 160 such that first tip 154 of spike 150 is adjacent seal 128 of container 120 and second tip 156 is adjacent seal 166 of cap 160.

To mix diluent D and ingredient P to produce a beverage using the embodiment illustrated in FIG. 2, package 110 is initially in a first, resting position illustrated in 6A, with tips 154 and 156 of spike member 150 adjacent to but not penetrating seals 128 and 166.

Figure 6A:
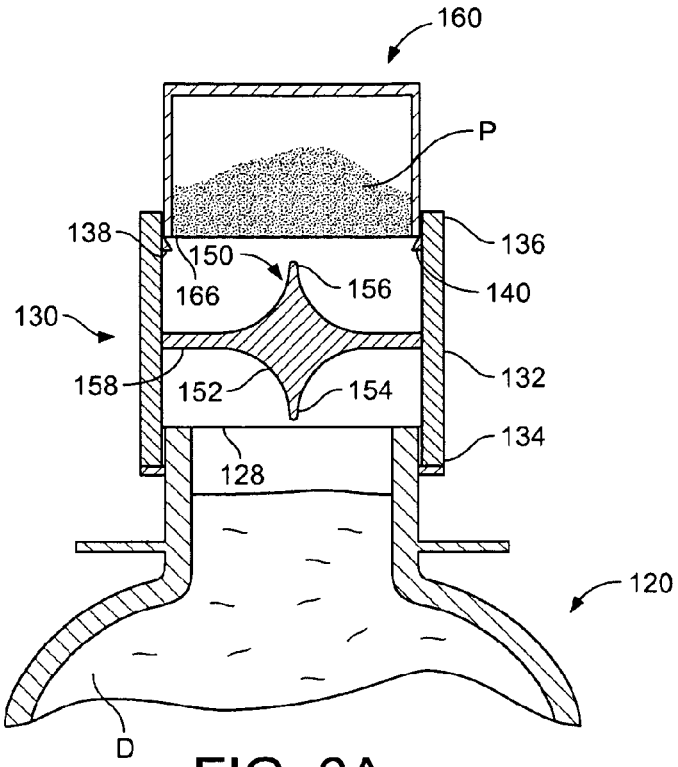
FIG. 6A illustrates sectional view of the package of FIG. 2 in a first position in an embodiment of the present disclosure.
Figure 6B:
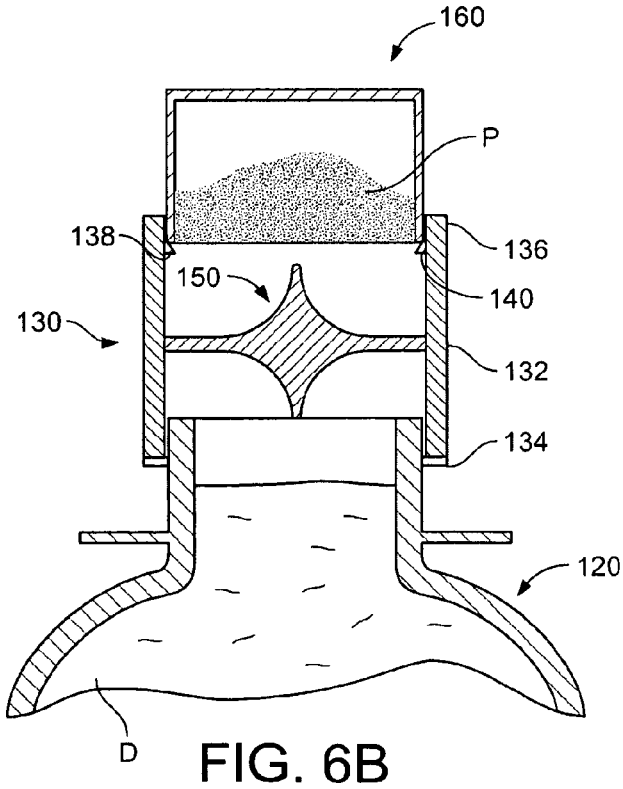
FIG. 6B illustrates sectional view of the package of FIG. 2 with the protective band removed in an embodiment of the present disclosure.
Figure 6C:
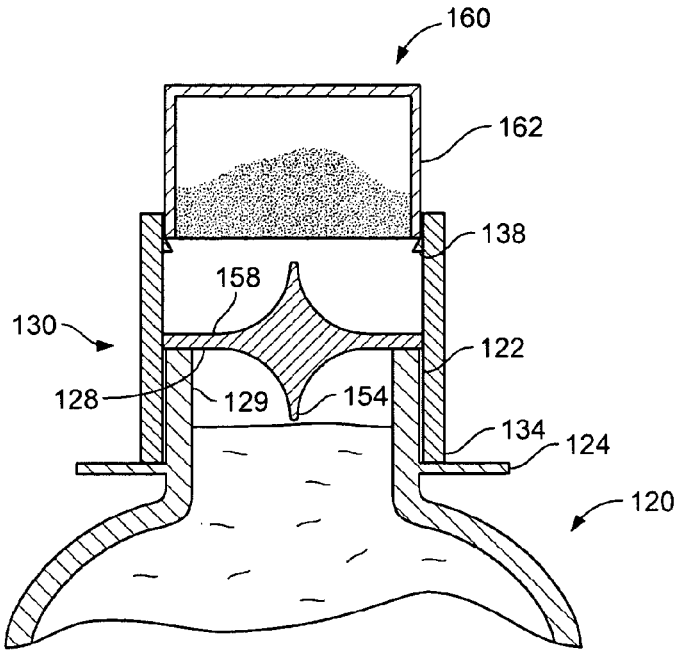
FIG. 6C illustrates sectional view of the package of FIG. 2 moving towards a second position in an embodiment of the present disclosure.

To penetrate seal 128 on container 120, band 180 is removed as illustrated in FIG. 6B. A downward force is then applied to cap 160 and/or adapter 130 to move adapter 130 as illustrated in FIG. 6C. The downward force causes spike tip 154 to penetrate seal 128 and enter neck 122 of container 120. Spike tip 154 continues to advance into neck 122 until adapter end 134 abuts ledge 124 and/or ribs 158 abut open end 129 of container 130.

Figure 6D:
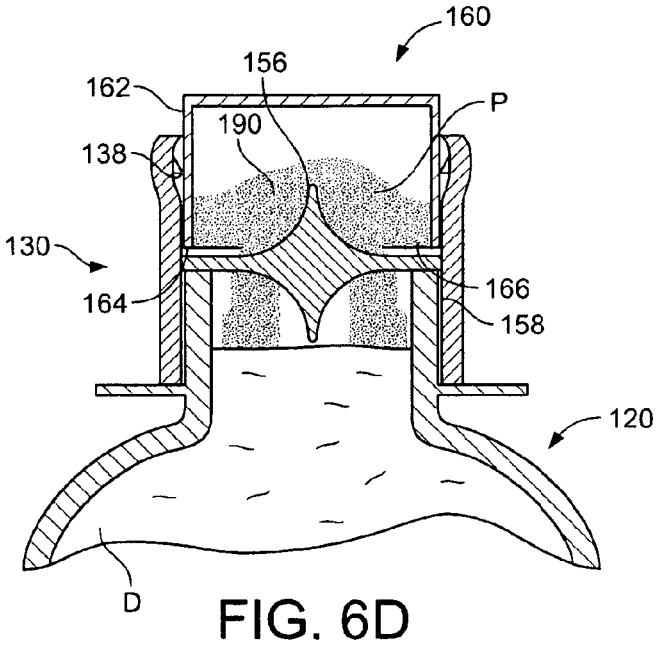
FIG. 6D illustrates sectional view of the package of FIG. 2 in a second, activated position in an embodiment of the present disclosure.

To penetrate seal 166 on cap 160, additional downward force is applied to move cap 160 as illustrated in FIG. 6D. The additional force causes annular wall 162 on cap 160 to overcome the fit against ledge 138 and move toward spike tip 156 until the tip penetrates seal 166 on cap 60 Annular wall 162 continues to advance through adapter 130 until wall end 164 abuts ribs 158. In this second, activated position, both seals 128 and 166 are penetrated, allowing ingredient P to exit cap 160 through a hole 190 formed in seal 166, travel through spaces defined between ribs 158, and into container 120 to mix with diluent D in the container to produce a beverage. A user may also shake package 100 to ensure that substantially all of ingredient P is mixed with diluent D.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A package comprising:

a container comprising a neck that defines a first open end sealed by a first seal, the container having a longitudinal axis;

an adapter comprising a flexible material and fixed to the first open end of the container, the adapter comprising a lower extension that circumscribes the neck of the container; and a cap comprising a second open end sealed by a second seal, the adapter is fixed to the second open end of the cap and is so constructed and arranged that it can penetrate the first seal and the second seal, wherein the adapter further comprises (i) a spike member positioned within the adapter between the first seal and second seal, and having a first tip configured to penetrate the first seal; and (ii) an annular ledge on an inside wall of the adapter, the ledge configured to receive the cap and fix the adapter to the second open end of the cap;

wherein the adapter is configured to penetrate the first seal and the second seal by moving from a first position to a second position, the lower extension comprises a section that is substantially parallel to the longitudinal axis in the first position of the adapter and slanted relative to the longitudinal axis in the second position of the adapter;

and wherein, in the first position, a vertical distance from a lower end of the adapter to the first tip is greater than the vertical distance from the lower end of the adapter to the first open end of the container, the vertical distance is substantially parallel to the longitudinal axis.

2. The package of claim 1, wherein the adapter comprises a plurality of spike members.

3. The package of claim 1, wherein the spike member is substantially centered within the adapter.

4. The package of claim 1, wherein the first seal and second seal are foil seals.

5. The package of claim 1 comprising a removable band positioned between the adapter and the container to maintain the adapter in the first position.

6. The package of claim 1, the adapter comprising internal threads configured to threadeably engage external threads on the container to fix the adapter to the first open end of the container.

7. A method for manufacturing the package of claim 1, the method comprising:

providing the container, the cap, and the adapter;

sterilizing the container;

filling the container with a liquid and sealing the container with the first seal in a sterile environment;

filling the cap with an ingredient and sealing the cap with the second seal in a non-sterile environment;

affixing the lower end of the adapter over the first open end of the container; and affixing an upper end of the adapter over the second open end of the cap.

8. The method of claim 7, wherein the ingredient is a powder.

9. The method of claim 7, wherein the ingredient is selected from the group consisting of a probotic, an oil, and combinations thereof.

10. The method of claim 7, comprising affixing the lower end of the adapter over the first open end of the container by a friction fit.

11. The method of claim 7, comprising:

inserting a band around the container; and affixing the lower end of the adapter over the first open end of the container to abut the band.

12. A method for using the package of claim 1 to produce a beverage, the method comprising:

providing the adapter, the container, and the;

affixing the lower end of the adapter over the first open end of the container;

affixing an upper end of the adapter over the second open end of the cap; and penetrating the first seal and the second seal with the spike member such that an ingredient housed in the cap mixes with a diluent housed in the container to form the beverage.

13. The method of claim 12, comprising moving the adapter downward along a wall of the container to penetrate the first seal with the spike member.

14. The method of claim 12, comprising moving the cap downward along the inside wall of the adapter to penetrate the second seal with the spike member.

15. The method of claim 12, comprising:

affixing a removable band over the first open end of the container; and affixing the lower end of the adapter over the first open end of the container and onto the band to maintain the adapter at the first position.

16. The method of claim 15, comprising:

removing the band; and moving the adapter from the first position to the second position to penetrate the first seal and the second seal.

* * * * *